United States Patent [19]

Edinger et al.

[11] 4,241,570

[45] Dec. 30, 1980

[54] METHOD AND APPARATUS FOR SEPARATING TWISTED WIRES

[75] Inventors: Egon Edinger, Graefelfing; Zdzislaw Przybylski, Munich, both of Fed. Rep. of Germany

[73] Assignee: Siemens Aktiengesellschaft, Berlin & Munich, Fed. Rep. of Germany

[21] Appl. No.: 45,947

[22] Filed: Jun. 6, 1979

[30] Foreign Application Priority Data

Jul. 31, 1978 [DE] Fed. Rep. of Germany ..... 2833563

[51] Int. Cl.[3] ..... D07B 7/18

[52] U.S. Cl. ..... 57/1 UN

[58] Field of Search ..... 57/1 R, 1 UN, 6, 9, 57/22, 23, 261, 311, 313, 314

[56] References Cited

U.S. PATENT DOCUMENTS

| | | | |
|---|---|---|---|
| 2,296,918 | 9/1942 | Gibson | 57/1 UN |
| 2,390,923 | 12/1945 | Cormier, Jr. | 57/1 UN |
| 2,836,012 | 5/1958 | Moorhouse et al. | 57/1 UN |
| 3,696,599 | 10/1972 | Palmer et al. | 57/1 UN |

*Primary Examiner*—John Petrakes

*Attorney, Agent, or Firm*—Hill, Van Santen, Steadman, Chiara & Simpson

[57] ABSTRACT

A method and apparatus for separating twisted wires, such as switching cables, has a rotatably driven central shaft to which a cable to be untwisted is co-rotatably mounted so that the cable ends are free. The cable is rotated inside of a stationary protective housing, having paddles movably mounted in the interior of the housing to momentarily engage the free cable ends as the cable rotates. The wire ends are thus diverted from the rotating plane at least twice per revolution, and are thereby stimulated to oscillate such that untwisting results. The angle of inclination of the paddles is selectively adjustable to adapt to cables of various numbers of twisted pairs and differing wire gauges.

6 Claims, 4 Drawing Figures

METHOD AND APPARATUS FOR SEPARATING TWISTED WIRES

BACKGROUND OF THE INVENTION

1. Field of the Invention:

The present invention relates to a method and apparatus for separating twisted wires, and in particular an automatic method and apparatus for same selectively adjustable for use with differing numbers and gauges of wires.

2. Description of the Prior Art:

Switching cables consist of conductors surrounded by insulation, with the conductors generally arranged in the form of twisted wire pairs, which pairs are in turn twisted to form triads, quads or pentads. After a section of such wire has been manufactured, it is frequently necessary to untwist the free ends of such cables for insertion into termination connectors and plugs after removal of the insulating sheath.

This operation has hitherto been carried out manually, resulting in a serious slow down of an otherwise automated process.

SUMMARY OF THE INVENTION

The present invention is a simple method and apparatus for the automatic separation of twisted wires, such as switching cable wires, after the cable insulating sheath has been removed. After such separation has occurred, further automated operation in the manufacturing of switching cables can be undertaken.

The separation is inventively achieved by mounting the cable on a driven shaft so that the free ends of the cable, with the insulation removed, are rotated. The rotation occurs inside of a stationary protective housing which has at least one adjustable paddle extending into the interior thereof which momentarily engages the free ends of the cable as it rotates. Such momentary engagement stimulates oscillations of the individual twisted wires, so that the wires are separated after a number of revolutions.

Conditions for separating different types of cables must be optimized according to the number of twisted pairs in the cable, and the gauge of wire comprising the cable. Interaction of oscillations, air resistance and centrifugal force must be considered in order to achieve the desired separation. The centrifugal force keeps the wire straight, returns it to the rotating plane, and overcomes the air resistance. The paddles are therefore adjustable with respect to the angle of inclination at which they are disposed with respect to the cable rotating plane.

In accordance with a further embodiment of the invention, a cable mounting consists of a cable support equipped with a rotating drive, and a cable positioning tube centrally disposed therein to contain a loop of the cable which is forced into the tube by means of a cooperatively shaped movable stamp. In this manner, it is possible to untwist random lengths during the manufacturer of switching cables, because the center section between the free ends can be inserted whatever distance is necessary to properly place the free ends.

A roller transport device may be utilized to transport a cable to be untwisted to a position opposite the housing between the mounting tube and the stamp.

DESCRIPTION OF THE PREFERRED EMBODIMENTS

Figure 1:
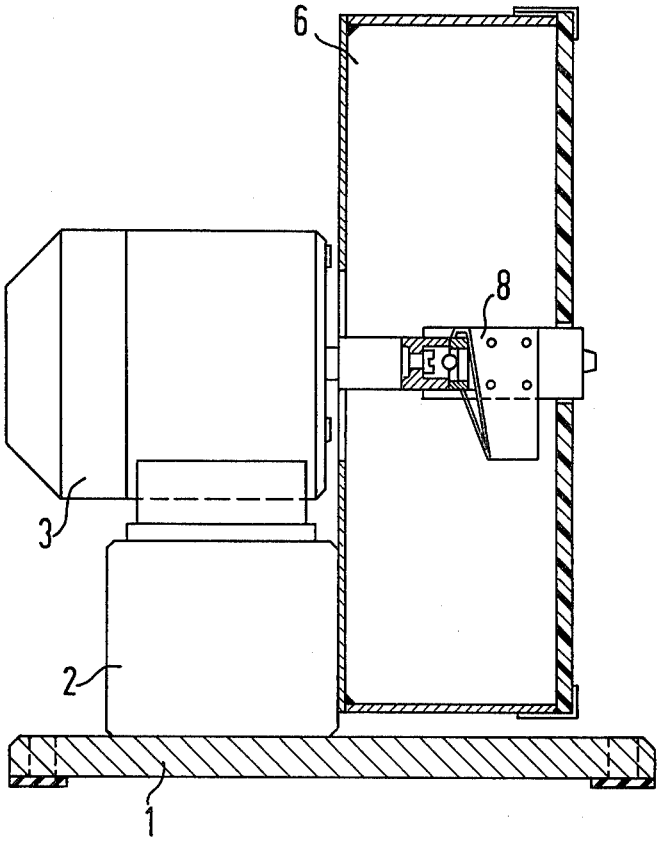
FIG. 1 is a sectional view taken along line I—I of FIG. 2 of an apparatus for separating twisted cable wires constructed in accordance with the principles of the present invention.
Figure 2:
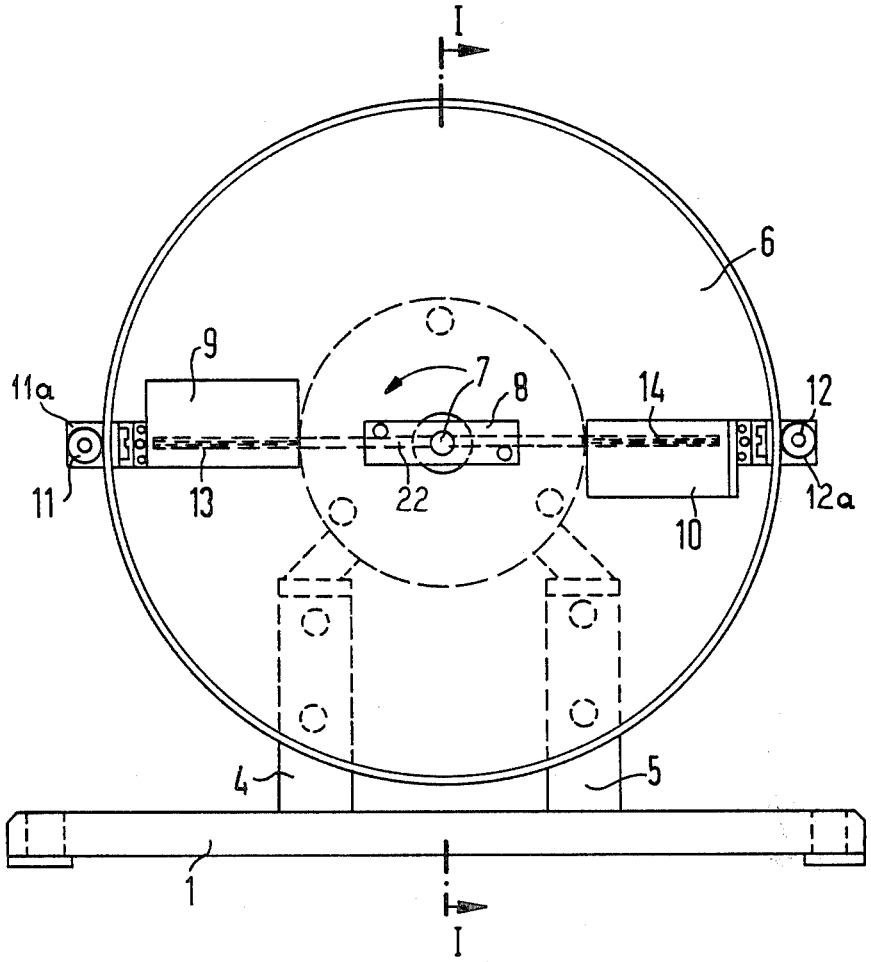
FIG. 2 is a front elevational view of the apparatus of FIG. 1.

An apparatus for separating twisted wires, so as switching cables comprised of a number of twisted pairs of wires is shown in FIGS. 1 and 2. The apparatus consists of a base plate 1, a essential device 2 and an electric motor 3.

A pair of mounting supports 4 and 5 are also attached to the base plate 1 for vertically supporting a cylindrical stationary protective housing 6.

The housing 6 encloses a motor shaft 7 extending axially through the housing 6 and a cable support-mounting 8 attached to the motor shaft 7. A wire 22 to be untwisted is held in the mounting 8 and is rotatable by the shaft 7 in the direction of the arrow shown. The wire 22 has free ends 13 and 14 from which the insulation has been removed.

A pair of oppositely disposed paddles 9 and 10 are attached to the interior of the housing 6. The position of the paddle 9 relative to the plane of rotation of the wire 22 is adjustable by a slide 11 movable in a channel 11*a*. The position of the paddle 10 is similarly adjustable by a slide 12 movable in channel 12*a*.

Figure 3:
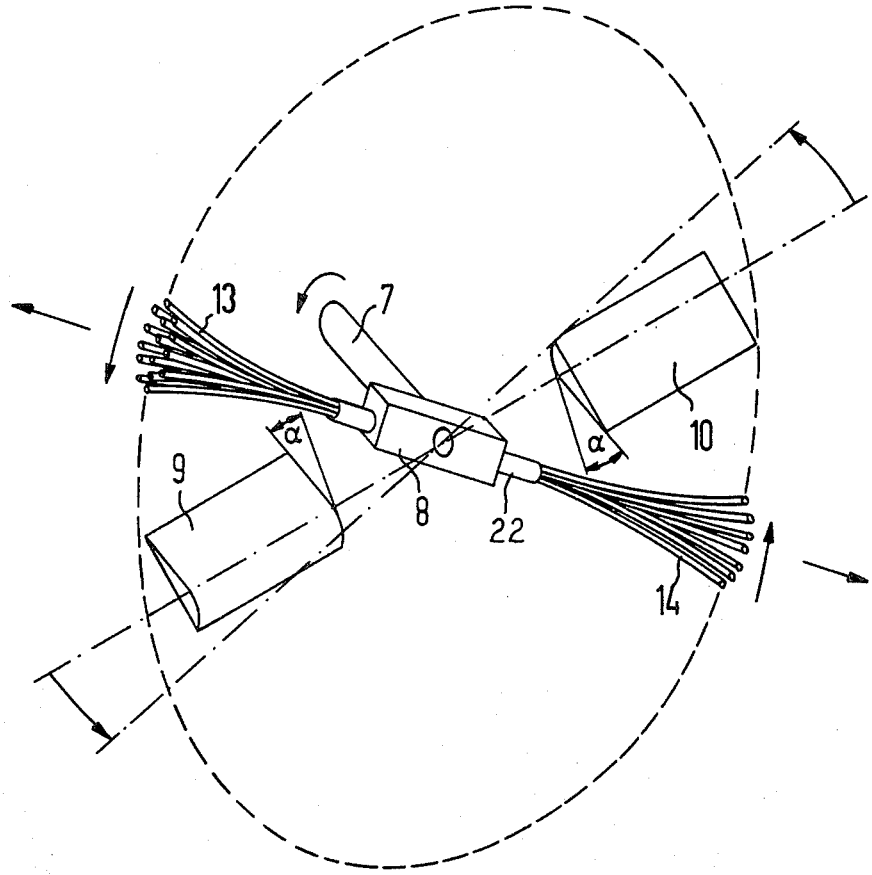
FIG. 3 is a schematic illustration of the wire-engaging parts of the device of FIG. 2 during an untwisting operation.

As shown in FIG. 3 the angle of inclination alpha of the paddles 9 and 10 with respect to the plane of rotation of the wire 22 is also adjustable. The position of the paddles 9 and 10 with respect to the wire rotation plane and the angle of the paddles with respect thereto are selected according to the number of strands of wire in the cable 22 and the wire gauge of the individual strands, for optimum separation.

As shown schematically in FIG. 3, operation of the apparatus is such that as the shaft 7 rotates, carrying the cable 22 therewith, the free ends 13 and 14 of the cable 22 are diverted from the plane of rotation twice per revolution by the paddles 9 and 10 which are shown in FIG. 3 disposed in an operating position. This momentary engagement of the free ends 13 and 14 against the paddles 9 and 10 stimulates the individual strands to oscillate, thereby effecting separation of the strands.

It will be understood that although only two paddles are shown in FIGS. 1 through 4, any number of paddles, including a single paddle may be utilized accordingly to the type of cable to be separated.

Figure 4:
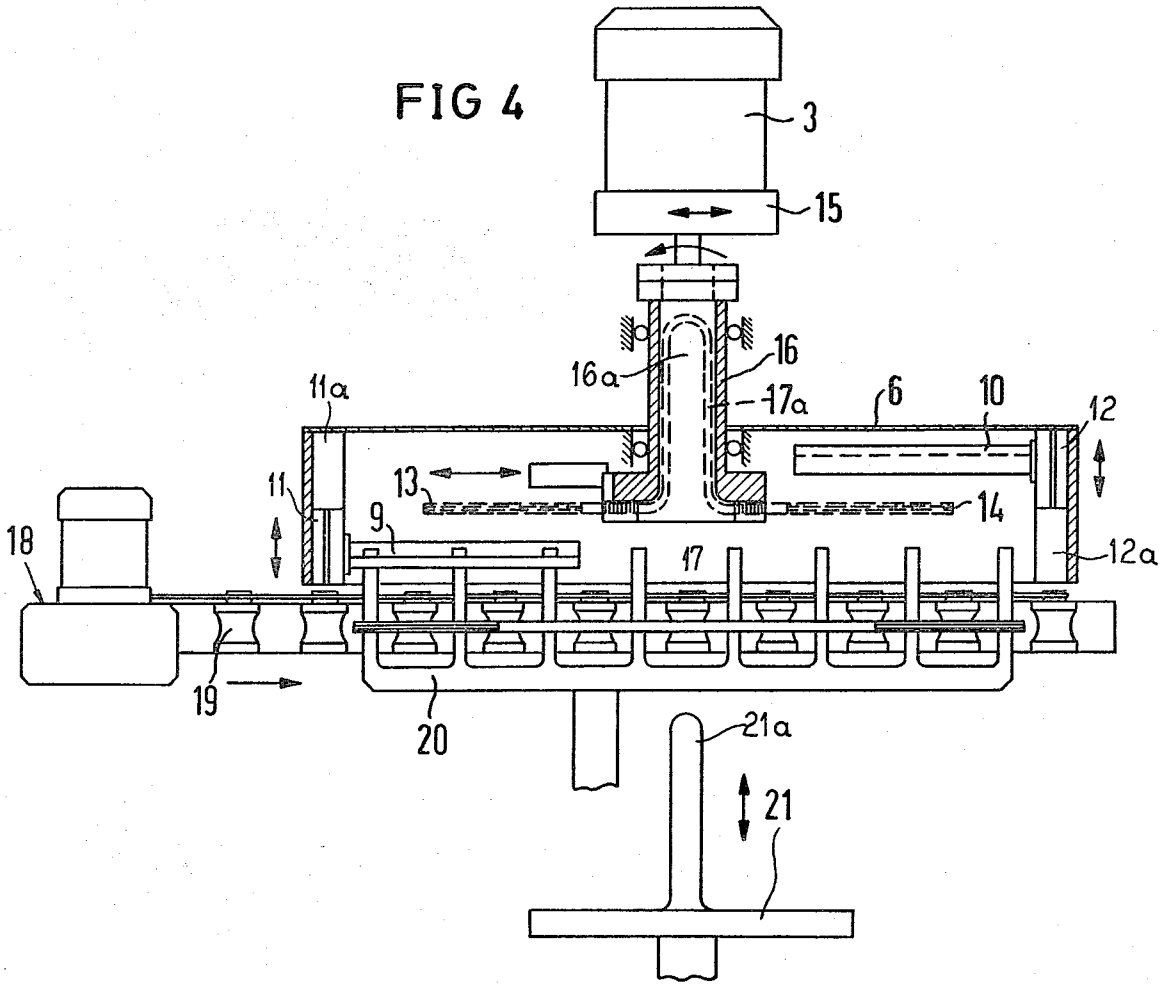
FIG. 4 is a plan view, partly in section, of the device of FIG. 2 adapted to receive random lengths of wire and including a wire transport and positioning device.

Another embodiment of the invention is shown in FIG. 4 wherein the shaft 7 is replaced by a shaft 16 having a hollow tube 16*a* centrally disposed therein. The apparatus of FIG. 4 also has a cable conveyor 18 having a plurality of rollers 19 for positioning a cable 17 to be separated in front of the housing 6. A generally comb-like cable lifting apparatus 20 is also positioned in front of the housing 6, and is sequentially controlled to lift a cable which has been conveyed in front of the housing 6 off of the rollers 19. When this occurs a stamp 21 having a plunger 21*a* thereon moves toward the shaft 16 to force the wire 17 into the tube 16*a* in the position 17*a* indicated by the dashed line.

The apparatus of FIG. 4 thus provides a means for positioning random lengths of cable 17 to be separated in the housing 6 so that their free ends 13 and 14 are properly positioned for engagement of the paddles 9 and 10 when the paddles 9 and 10 are moved into an operating position by the respective slides 11 and 12. By controlling the depth of insertion of the plunger 21*a* in the tube 16*a*, any length of cable can be accommodated.

As also shown in FIG. 4, the motor 3 may be equipped with a brake 15 to stop rotation of the shaft 16 after the desired separation has been achieved.

Although modifications and changes may be suggested by those skilled art it is the intention of the inventors to embody within the patent warranted hereon all modifications and changes as reasonably and properly come within their scope and contribution to the art.

We claim as our invention:

1. An apparatus for the automatic untwisting of twisted wires having two free ends comprising:
   - a stationary cylindrical housing;
   - a drive means having a drive shaft extending axially into said housing;
   - a wire holder for receiving wires to be untwisted attached to said drive shaft in said housing and co-rotatable therewith;
   - at least one paddle supported by and extending inwardly from said housing;
   - a paddle positioner for each paddle having an adjustable portion outside said housing operable to move a paddle from a rest position to an operating position which is in a plane of rotation of said wires in said wire holder; and
   - a means for adjusting an angle of incidence of said paddle with respect to said plane of rotation, whereby upon rotation of said wires in said wire holder said free ends momentarily engage at least one paddle during a revolution, thereby inducing oscillations in the wires to untwist the wires.

2. The apparatus of claim 1 wherein said wire holder is a tube for receiving a central portion of said wires to be untwisted.

3. The apparatus of claim 2 including a movable plunger received in said tube for inserting said central portion of said wires a selected distance therein.

4. The apparatus of claim 1 wherein said stationary housing has one open face opposite said drive means and a plurality of rollers are disposed at said open face for moving a wire to be untwisted in front of said housing for mounting in said wire holder.

5. A method for automatically untwisting twisted wires having two free ends comprising:
   - mounting wires to be untwisted in a rotatable holder in a housing;
   - moving at least one paddle mounted in the interior of said housing to a position in a plane of rotation of said wires in said holder;
   - adjusting an angle of incidence of said paddle with respect to said plane of rotation;
   - rotating said holder and said wires so that said free ends momentarily engage said paddle during a revolution;
   - inducing oscillations in said free ends of said wires to untwist the free ends;
   - stopping rotation; and
   - removing said wires from said holder.

6. The method of claim 5 wherein the step of mounting a wire to be untwisted in a rotatable holder comprises the steps of:
   - moving a wire to be untwisted in front of an open face of said housing; and
   - forcing a central portion of said wire a selected distance into an axially tube in said holder.

* * * * *